US008449326B2

(12) United States Patent
Holland et al.

(10) Patent No.: US 8,449,326 B2
(45) Date of Patent: May 28, 2013

(54) COAXIAL CONNECTOR JACK WITH MULTIPURPOSE CAP

(75) Inventors: Michael Holland, Santa Barbara, CA (US); Brad Niems, Somis, CA (US)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 13/110,882

(22) Filed: May 18, 2011

(65) Prior Publication Data

US 2012/0295476 A1 Nov. 22, 2012

(51) Int. Cl.
*H01R 9/05* (2006.01)

(52) U.S. Cl.
USPC ..... 439/578

(58) Field of Classification Search
USPC ..... 439/381, 843, 675, 578, 579–585
See application file for complete search history.

(56) References Cited

U.S. PATENT DOCUMENTS

| | | | | |
|---|---|---|---|---|
| 3,292,136 | A * | 12/1966 | Somerset | 439/584 |
| 3,470,524 | A * | 9/1969 | Culver | 439/317 |
| 4,998,891 | A * | 3/1991 | Bresko | 439/369 |
| 5,775,960 | A * | 7/1998 | Saito et al. | 439/843 |
| 6,896,545 | B2 * | 5/2005 | Suess et al. | 439/521 |
| 6,994,600 | B2 * | 2/2006 | Coulon | 439/843 |
| 2001/0051471 | A1 * | 12/2001 | Saka et al. | 439/843 |
| 2007/0105439 | A1 * | 5/2007 | Burris et al. | 439/578 |

* cited by examiner

*Primary Examiner* — Renee Luebke
*Assistant Examiner* — Harshad Patel
(74) *Attorney, Agent, or Firm* — Paul D. Chancellor; Ocean Law

(57) ABSTRACT

A 75 ohm MCX coaxial cable connector jack includes multipurpose metallic pin cap.

2 Claims, 7 Drawing Sheets

COAXIAL CONNECTOR JACK WITH MULTIPURPOSE CAP

BACKGROUND OF THE INVENTION

1. Field of the Invention

The present invention relates to an article of manufacture for conducting electrical signals. In particular, an MCX ("Micro Coaxial") type RF connector jack utilizes a metallic shell or cap to maintain a characteristic impedance of 75Ω (ohms) while protecting the connector center contact.

2. Discussion of the Related Art

MCX connectors are coaxial radio frequency ("RF") connectors developed in the 1980's as smaller versions of the widely used SMB (subminiature) type connectors. Like SMB connectors, the MCX connectors include a plug and jack with an integral push-on/snap-on coupling. MCX connector jacks typically have the same inner contact and insulator dimensions as SMB connectors, but are about 30% smaller. MCX connector standards are found in European CENELEC Electronic Components Committee (CECC) standard 22220.

Notably, MCX connectors have traditionally had a 50 ohm impedance and were used solely for connecting coaxial cables having outside diameters in the range of 1-5 mm. These 50 ohm applications include GPS receivers, microwave, wireless communications, and automotive communications systems.

Although MCX connectors have mainly been used for 50 ohm applications, the small size, superior RF performance, and ease of connectivity have suggested this connector for newer high-density 75 ohm applications such as broadcast and data routers. However, changing the connector impedance from 50 to 75 ohms has led to connector design changes that sacrifice connector mechanical integrity to achieve the desired 75 ohm characteristic impedance. The electrical performance level required to meet the new 75 ohm requirement is a return loss of better than −20 dB.

Connector jack impedance is mostly determined by the distance and material between the outer diameter of the pin contact and the inner diameter of the jack's outer shell. The 50 ohm MCX jack dimensions are set to assure a 50 ohm impedance while incorporating a protective dielectric shell and air between the pin and outer body inside diameter. In order to make the MCX jack design perform well at 75 ohms, the dielectric/insulating shell may not be used; this leaves the fragile, slotted pin contact (sometimes referred to as a "seizing" pin) surrounded only by air. This greatly compromises the mechanical integrity of the 75 ohm MCX design.

The mechanical integrity of MCX jacks is compromised when 50 ohm jacks are redesigned for 75 ohm operation by removal of the dielectric insulator surrounding the center pin contact. This modification leaves the jack's fragile pin contact unguarded and unsupported. When dealing with these fragile jacks, users must take special care to avoid damaging the pin contact. In many cases, expensive re-working of equipment with these MCX jacks is required due to jack pin contacts that have been deformed and/or broken by insertion of an off-axis/misaligned male center pins of MCX plugs.

FIG. 1A shows a prior art 50 ohm MCX jack 100A and FIG. 2 shows a mating prior art 50 ohm MCX plug 200. The jack includes a female pin 112 having a pin shank 110 and a pin contact 104. A plurality of slots 108 (one shown) in the pin contact provide for a spring-like receptacle action of the pin contact. Adjacent to the pin contact slots are interposed pin contact tines 106. The female pin is centrally located in a jack outer shell 102 having a jack base 103.

FIG. 1B shows a prior art dielectric insulator 100B having a pin shank cover 132 and a pin contact cover 134. The pin shank cover is inserted in a jack base insulator 114 which is in turn inserted in the jack base 103. The dielectric insulating structure 116 surrounds and supports the jack's contact pin providing protection against damage from insertion of off-axis/misaligned male pin contacts 204.

The plug 200 includes a male pin 212 having a shank 210 and a pin contact 204. The male pin contact 204 is for insertion in the jack's female pin contact 104 when the connectors are mated. The plug and jack are mated when the male pin contact is inserted in the female pin contact and the ridge 218 near the free end of the plug body 202 snaps into the groove 118 of the jack's outer shell 102 near the jack base 103.

FIG. 3 shows a prior art 75 ohm MCX jack 300 and FIG. 4 shows a mating prior art 75 ohm MCX plug 400. Like the plug of FIG. 2, the 75 ohm MCX plug of FIG. 4 includes a male center pin 412 having a pin contact 404 and a pin shank 410 arranged centrally in a plug outer shell 402. And, like the jack of FIG. 1, the 75 ohm MCX jack 300 includes a female pin 312 having a pin contact 304 and a pin shank 310 arranged centrally in a jack outer shell 302. However, unlike the 50 ohm jack of FIG. 1, the 75 ohm jack of FIG. 3 has no dielectric insulator or other part around the pin contact. Rather, the pin shank is inserted directly into a jack base insulator 314 leaving the pin contact uncovered and unsupported.

FIG. 5 shows a prior art 75 ohm MCX jack and plug 500. Here, there is an attempt to insert an off-axis/misaligned plug 502 into a mating jack 504 as indicated by a misalignment angle θ. Because of the misalignment, the male pin contact 501 tends to push and bend the tines 516 of the female pin contact 514 away from the centerline y-y of the jack. In an exemplary case of a misaligned insertion, forces exerted on the plug FR (components $F_X$ and $F_Y$) have a misdirected or misaligned component $F_X$ that tends to bend the contact tines.

In the case of prior art 75 ohm MCX jacks, misalignment of the plug during plug insertion commonly bends and damages the tines 516 of the female pin contact 514.

SUMMARY OF THE INVENTION

In the present invention, an MCX jack includes a multipurpose metallic cap. The cap is configured to maintain a jack characteristic impedance of 75 ohms while protecting the jack's pin contact.

In an embodiment, the invention provides a thin-walled cylinder or pin cap covering a receptacle or pin contact of a female center pin. The thin-walled cylinder is attached below the receptacle to provide added stability. A space is made available in the pin cap inside diameter around the receptacle allowing for expansion when a male pin contact is inserted. The pin cap wall thickness and materials allow for the resulting connector to be well matched to 75 ohms. The entry end of the pin cap is tapered to provide a funnel type guide to better guide the pin contact of a male plug into the female receptacle without damaging the tines of the female receptacle. An inside diameter of the pin cap is sized to securely fit with a solid portion of the center pin below the receptacle to provide both axial and radial strength.

In an embodiment, a 75 ohm MCX coaxial connector jack comprises a jack base insulator extending between a female center pin and a jack outer shell. A multipurpose metal pin cap is fitted to a pin contact of the female center pin; and, the pin cap is operable to protect the female pin contact when an attempt is made to insert a misaligned MCX coaxial connector plug into the jack.

In some embodiments, the jack above further comprises a guide-way to the female pin contact; the guide-way includes a substantially conically shaped pin cap mouth; and, the pin cap mouth is operable to guide the pin contact of a male center pin of a misaligned MCX coaxial connector plug into the female pin contact.

In some embodiments, the jack above further comprises one or more pin cap sidewalls radially outward of the tines of the female pin contact. Here, the pin cap sidewalls are operable to resist forces tending to bend the female pin contact tines when the attempt is made to insert the misaligned MCX coaxial connector plug into the jack.

In some embodiments, the jack above further comprises one or more pin cap sidewalls of sufficient length to transfer forces imposed on the pin cap mouth to a portion of the female center pin that is beyond the female pin contact tines and substantially adjacent to the jack base insulator.

And, in some embodiments, the jack above has a continuous pin cap sidewall. And, in yet other embodiments, the jack above has a slotted pin cap sidewall.

BRIEF DESCRIPTION OF THE DRAWINGS

The present invention is described with reference to the accompanying figures. These figures, incorporated herein and forming part of the specification, illustrate the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of embodiments they disclose. For example, other embodiments of the disclosed device and/or method may or may not include the features described herein. Moreover, disclosed advantages and benefits may apply to only certain embodiments of the invention and should not be used to limit the disclosed invention.

To the extent parts, components and functions of the described invention exchange electric power or signals, the associated interconnections and couplings may be direct or indirect unless explicitly described as being limited to one or the other. Notably, parts that are connected or coupled may be indirectly connected and may have interposed devices including devices known to persons of ordinary skill in the art.

Figure 2:
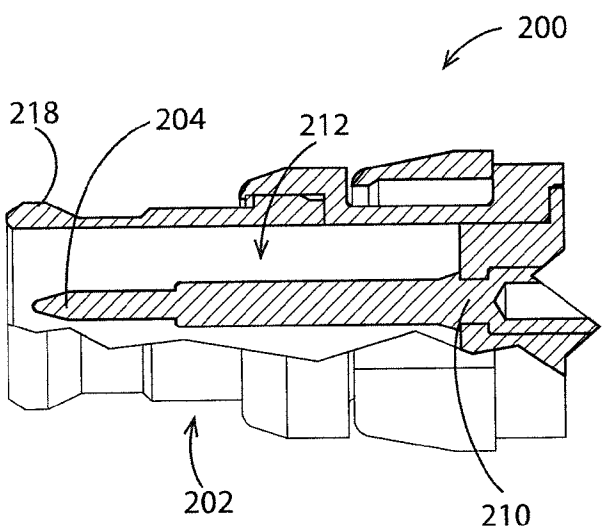
FIGURE 2 (Prior Art)
FIG. 2 shows a prior art 50 ohm MCX plug.
Figure 1A:
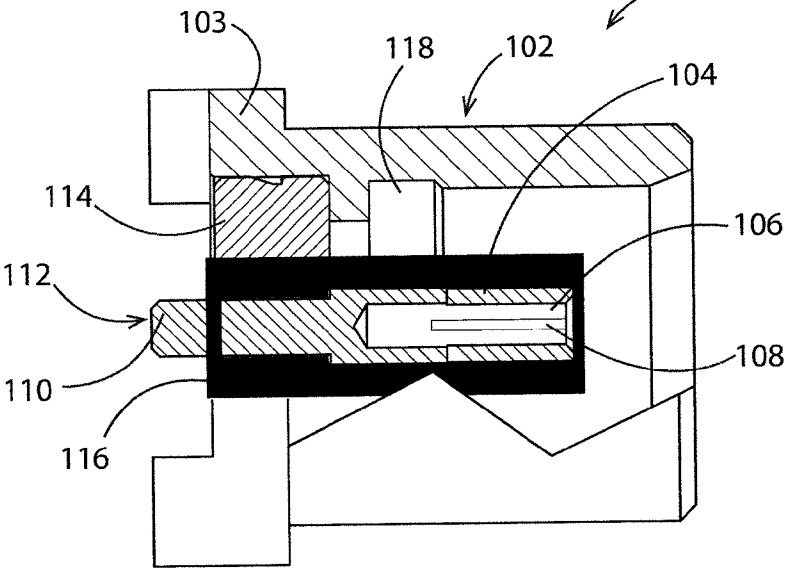
FIGURE 1A (Prior Art)
FIG. 1A shows a prior art 50 ohm MCX jack having a dielectric insulator surrounding the female center pin.
Figure 1B:
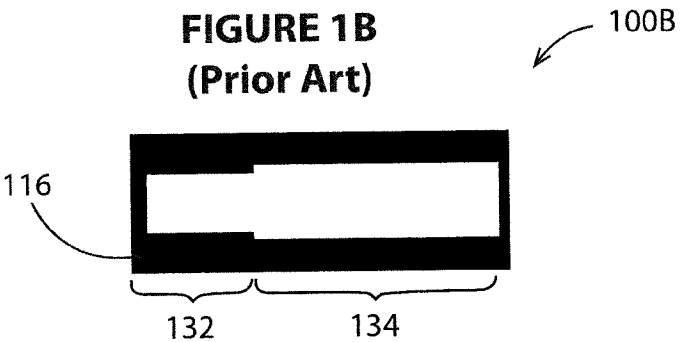
FIGURE 1B (Prior Art)
FIG. 1B shows a prior art dielectric insulator for use with the jack of FIG. 1.
Figure 4:
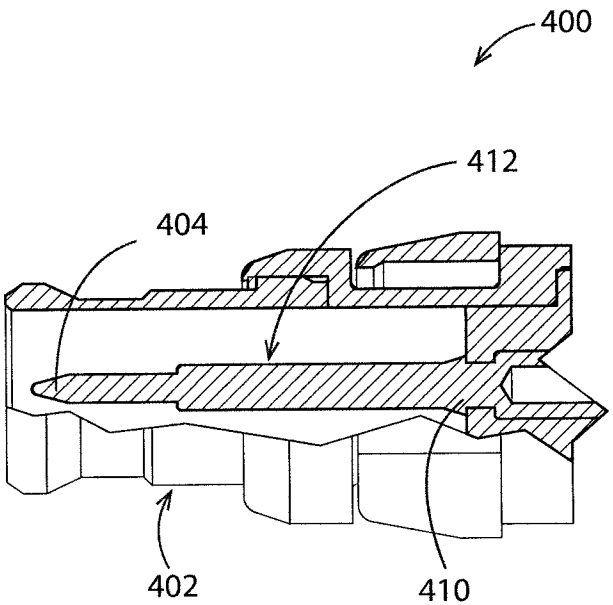
FIGURE 4 (Prior Art)
FIG. 4 shows a prior art 75 ohm MCX plug.
Figure 3:
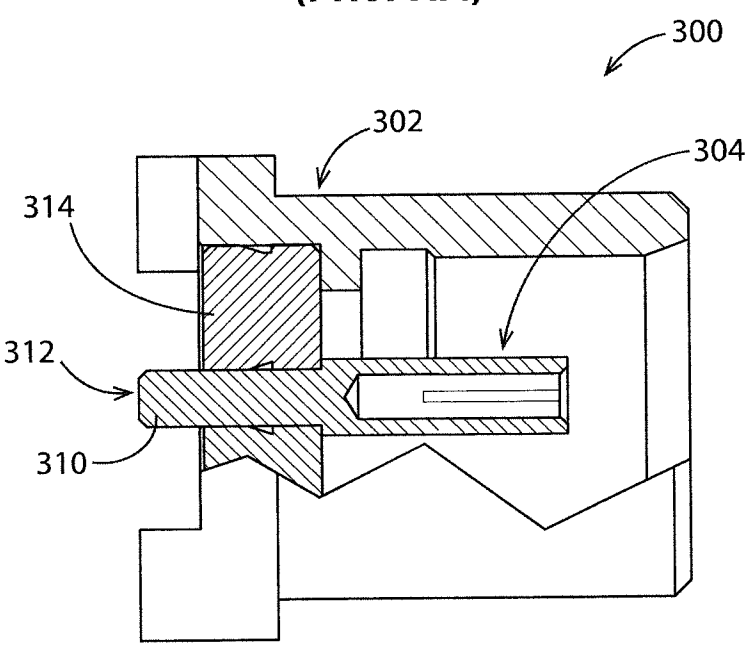
FIGURE 3 (Prior Art)
FIG. 3 shows a prior art 75 ohm MCX jack.
Figure 5:
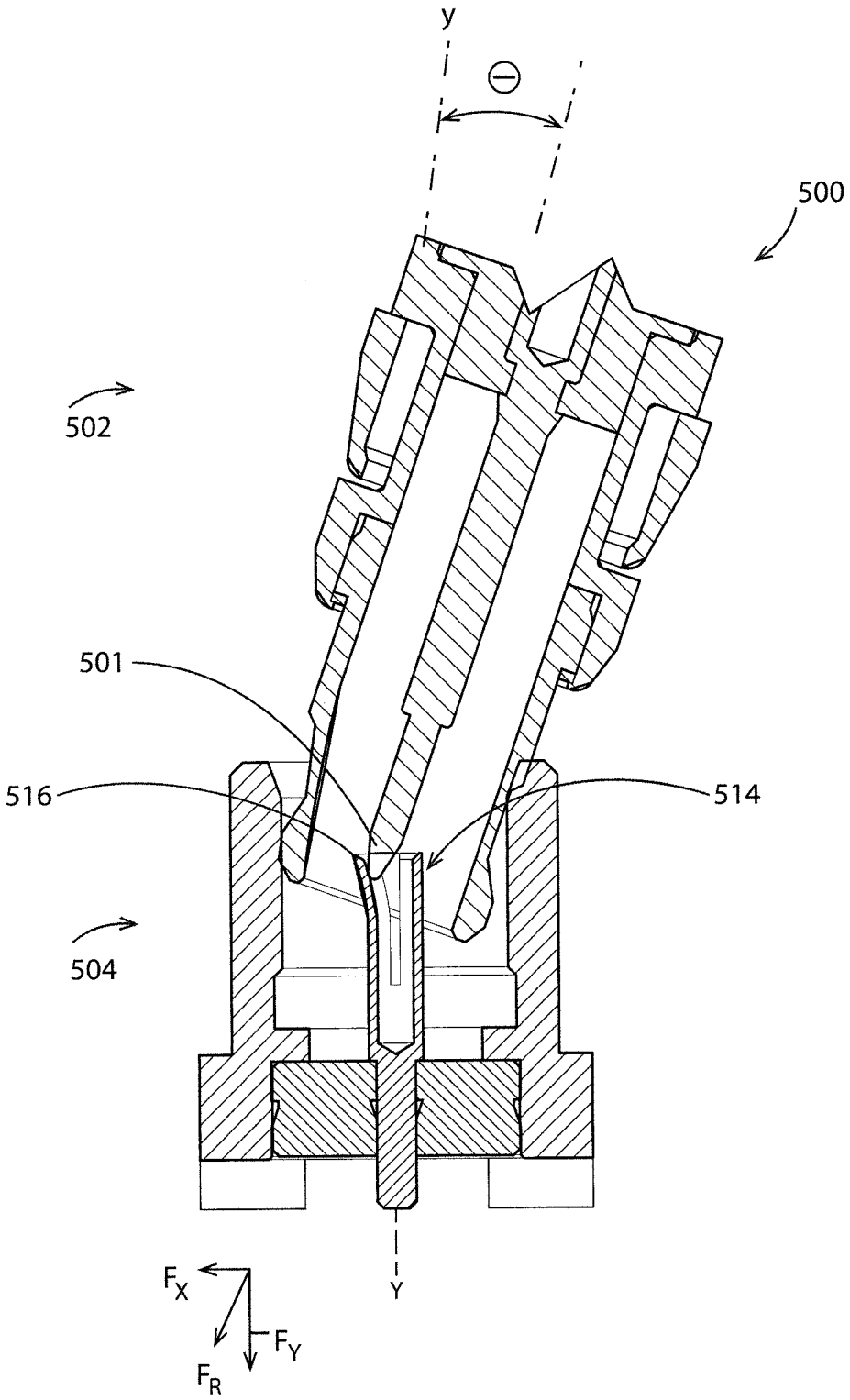
FIGURE 5 (Prior Art)
FIG. 5 shows a prior art 75 ohm MCX jack and a prior art MCX plug.
Figure 6A:
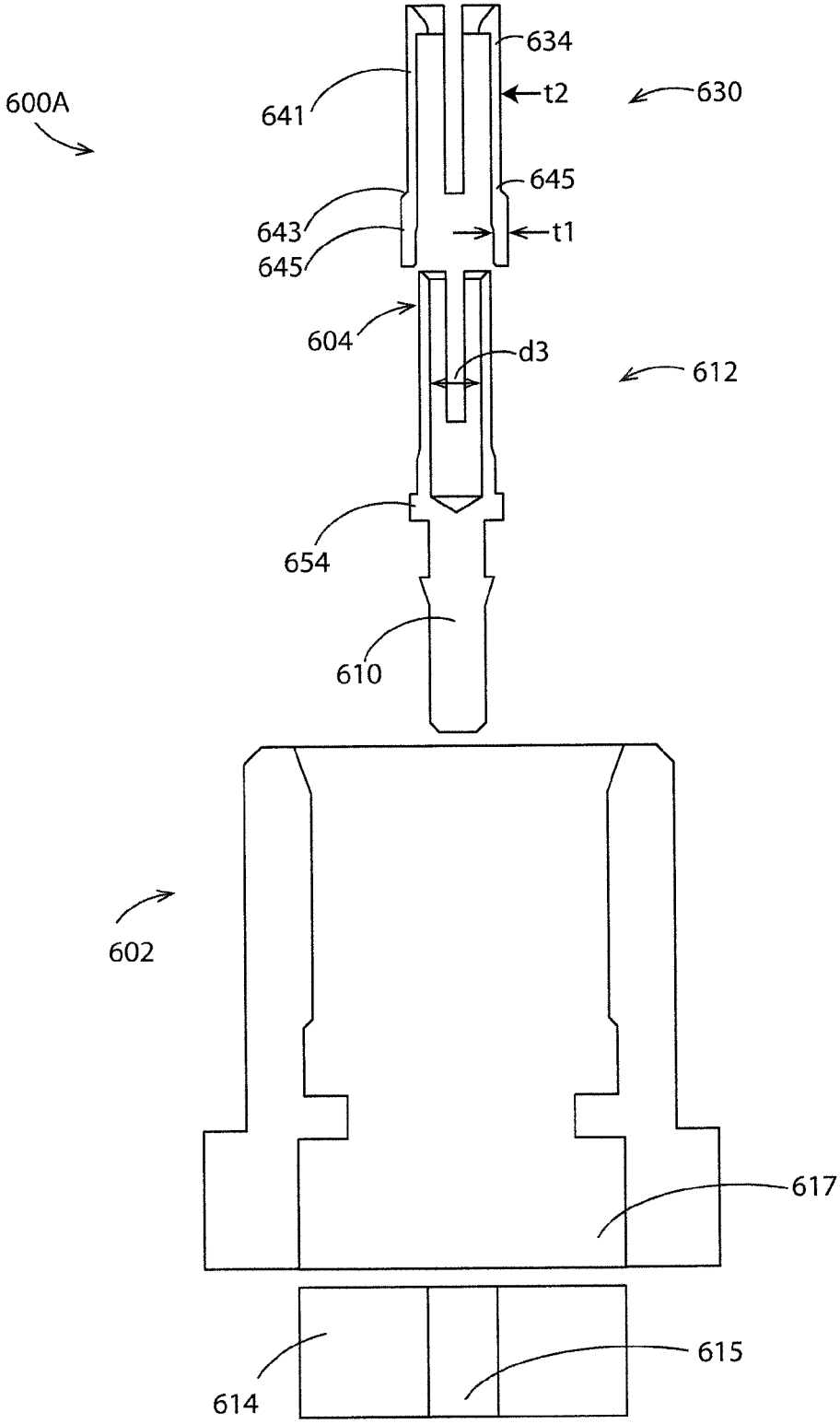
FIG. 6A shows an exploded view of a 75 ohm MCX jack in accordance with the present invention.

FIG. 6A shows a 75 ohm MCX jack in accordance with the present invention 600A. As described above, the MCX jack includes a central female pin 612, a jack outer shell 602, and a jack base insulator 614.

The central pen 612 has a pin contact 604 with an outer diameter d2 and a pin shank 610. Some embodiments include a boss 654 encircling the central pin adjacent to the pin shank. In various embodiments, the central pin 612 is for insertion in a hole 615 of a jack base insulator 614 that is for insertion in a jack base cavity 617 formed in the jack outer shell 602.

Unlike prior art MCX connectors, the MCX 75 ohm jack of FIG. 6A includes an electrically conductive pin contact support. As shown, the support is in the form of a pin contact cap or pin cap 630 that fits over the female pin contact 604. In various embodiments, the pin cap is made from one or metals or metal alloys suited for use as or in conjunction with coaxial connector electrical spring contacts. Exemplary metals and metal alloys include those known to persons of ordinary skill in the art including one or more of copper, beryllium, silver, gold, and aluminum.

A wall thickness t1 of a lower sidewall or base portion of the pin cap 645 is, in some embodiments, greater than a wall thickness t2 of an upper sidewall of the pin cap 634. Greater pin cap sidewall thickness (645 and or 634) is used in some embodiments to provide a more robust interference fit between the pin cap sidewall and the contact pin 604.

Figure 6B:
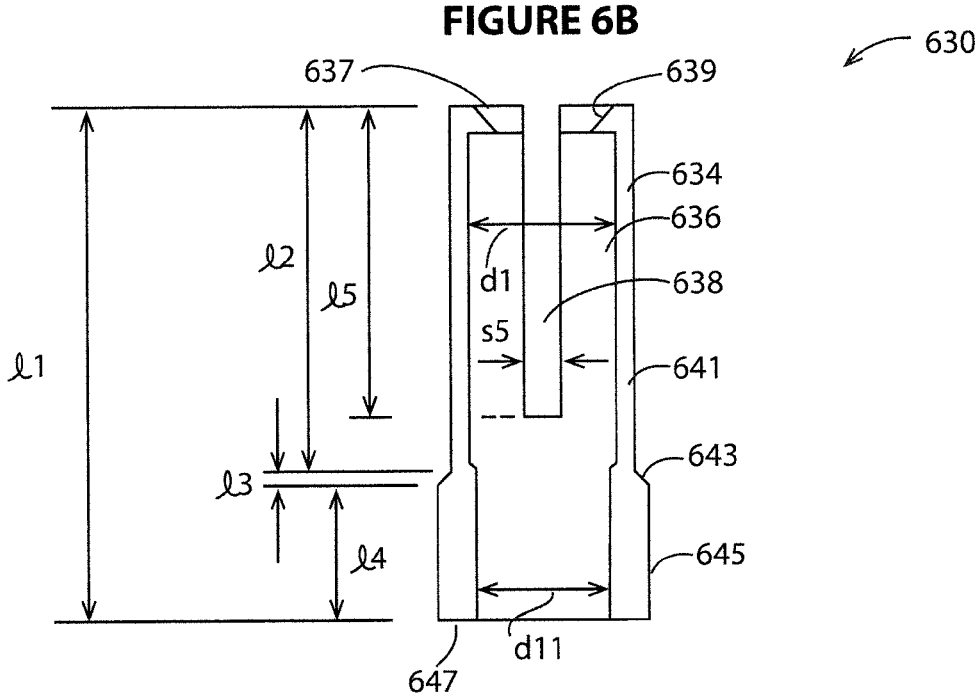
FIG. 6B shows an enlarged pin cap of the MCX jack of FIG. 6A.
Figure 6C:
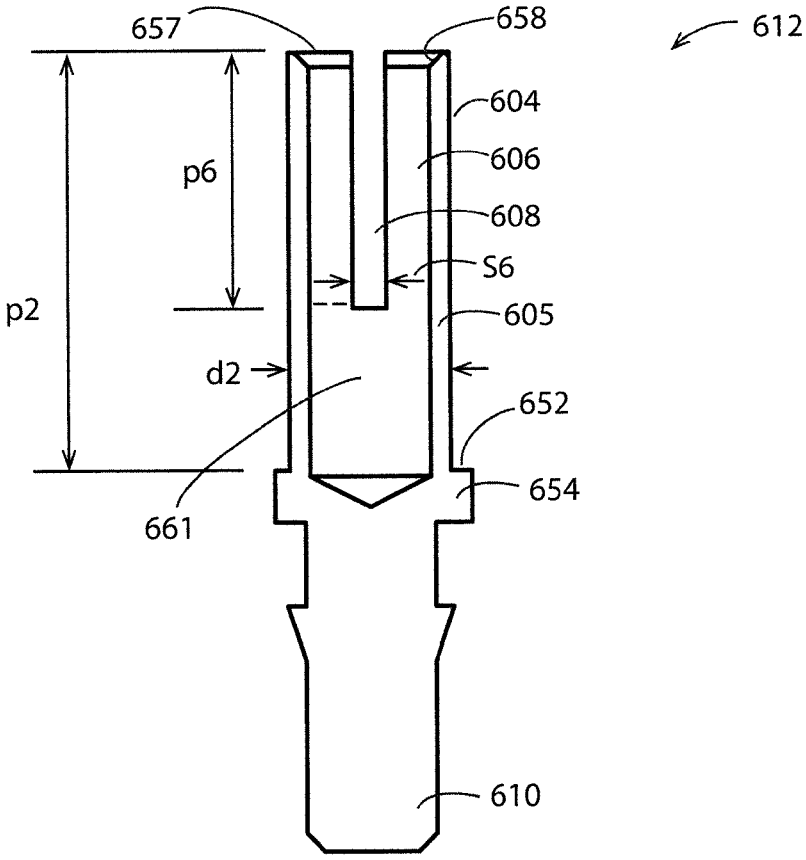
FIG. 6C shows an enlarged female center pin of the MCX jack of FIG. 6A.

FIGS. 6B and 6C show enlarged cross-sections of the pin cap and the female central pin 630, 612.

The pin cap 630 has one or more inner diameters d1, d11. In various embodiments, a fitted inner diameter of the pin cap d11 is matched to an outer diameter d2 of the pin contact 604. In some embodiments, a pin contact bore 661 stops short of the pin contact boss 654 such that the pin contact is solid in the region marked by the diameter d2. Matched diameters includes, in various embodiments, dimensions providing an interference fit and dimensions providing a gap such as a gap that is filled or partially filled with a conductive material such as solder or another material suitable for joining the pin contact and the pin cap. And, in various embodiments, an unfitted inner diameter of the pin cap d1 provides gap between the pin cap and the female pin contact 604 allowing the female pin contact to expand when a male pin contact (see FIG. 8) is inserted.

The central pin includes a pin contact 604 having a pin contact sidewall 605. In various embodiments, the pin contact sidewall is interrupted by one or more slots 608 of width s6 extending for a length p6 from a pin contact mouth 657.

Adjacent to the slot(s) are the pin contact tines 606. Each slot divides the pin contact sidewall such that for n slots, there are (n+1) tines. As persons of ordinary skill in the art will understand, when the inner diameter d3 (see FIG. 6A) of the pin contact is interrupted by slot(s) 608, a variable diameter spring contact is formed. In various embodiments, d3 is selected to provide a tight fit with a male pin contact with an outer diameter of approximately 0.48 mm. As further discussed below, this variable diameter spring contact is useful for receiving a male central contact pin of an MCX plug. In various embodiments, the pin contact has a chamfer 658 at a pin contact mouth 657 for guiding and receiving a male pin contact.

The pin cap 630 includes a pin cap sidewall 634 with one or more pin cap sidewall slots 638 of width s5 and length l5. As shown, the pin cap 630 has a length l1 for engaging a substantially equal length p2 of the pin contact. In some embodiments, p2 is approximately 4.5 mm and l1 is approximately 4.5 mm. And, in some embodiments s5 is in the range of approximately 0.1 mm to 0.45 mm.

Figure 7:
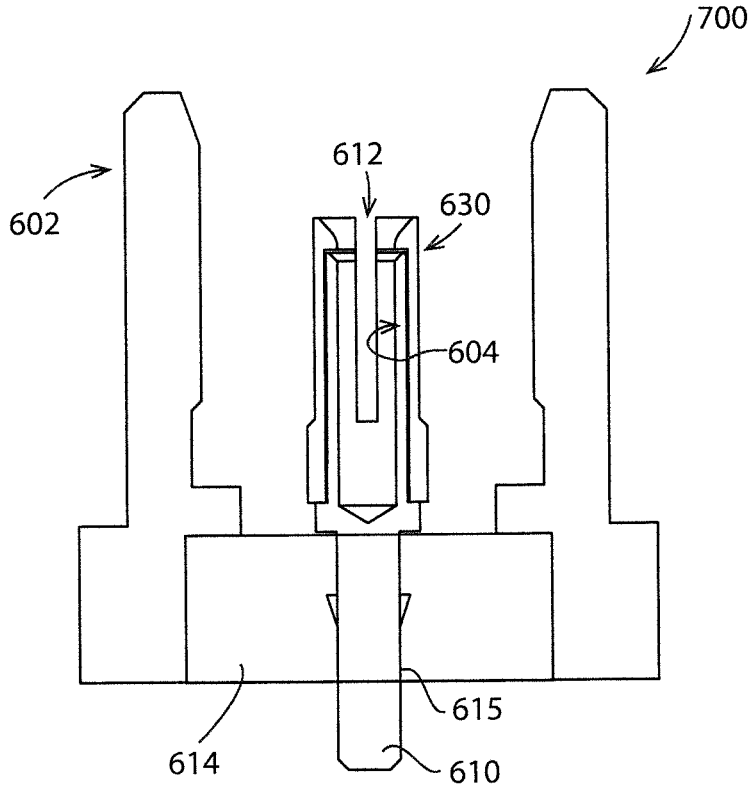
FIG. 7 shows an assembled view of the 75 ohm MCX jack of FIG. 6A.

In some embodiments, assembly of the pin cap 630 and female center pin 612 brings the pin cap base face 647 into contact with an upper shoulder 652 of the female center pin boss 654 (see also FIG. 7). And, in some embodiments, the pin cap has variable wall thickness with a transition therebetween. For example, in the embodiment shown, a pin cap wall thickness transition 643 has a length l3 separating an upper sidewall 641 with a thickness t2 and length l2 from a lower sidewall 645 with a thickness t1 and length l4 where (t1>t2). In some embodiments, t1 is in the range of approximately 0.125 mm to 0.225 mm and t2 is in the range of approximately 0.05 mm to 0.15 mm. And, in some embodiments l4 is in the range of approximately 0.8 mm to 1.6 mm.

In some embodiments, the pin cap has tines 636. Here, the pin cap tines are adjacent to the slot(s) 638. Each slot divides the pin cap sidewall such that for n slots, there are (n+1) tines. As persons of ordinary skill in the art will understand, when the inner diameter d1 of the pin cap is interrupted by slot(s) 638, a variable diameter spring cap is formed. As is further discussed below, this cap is useful for supporting and protecting the female pin contact. In various embodiments, the pin cap has a chamfer 639 at a pin cap mouth 637 for guiding and receiving a male pin contact.

When the pin cap and female pin contact are assembled, the slot(s) 638, 608 are, in some embodiments, aligned or partially aligned.

FIG. 7 shows an assembled 75 ohm MCX jack 700. Here, the female pin shank 610 is inserted through the hole 615 in the jack base insulator 614 which is in turn inserted in the base cavity 617 of the jack outer shell 602. In addition, the installed pin cap 630 covers the pin contact 604 of the female center pin 612.

In alternative embodiments, parts of the 75 ohm MCX jack are combined as integral units. For example, in some embodiments the pin cap 630 and the female center pin 612 comprise an integral unit such as pin cap/center pin units made by machining, punching, drawing, and/or casting operations.

In operation, the pin cap 630 protects and supports the female pin contact.

Figure 8:
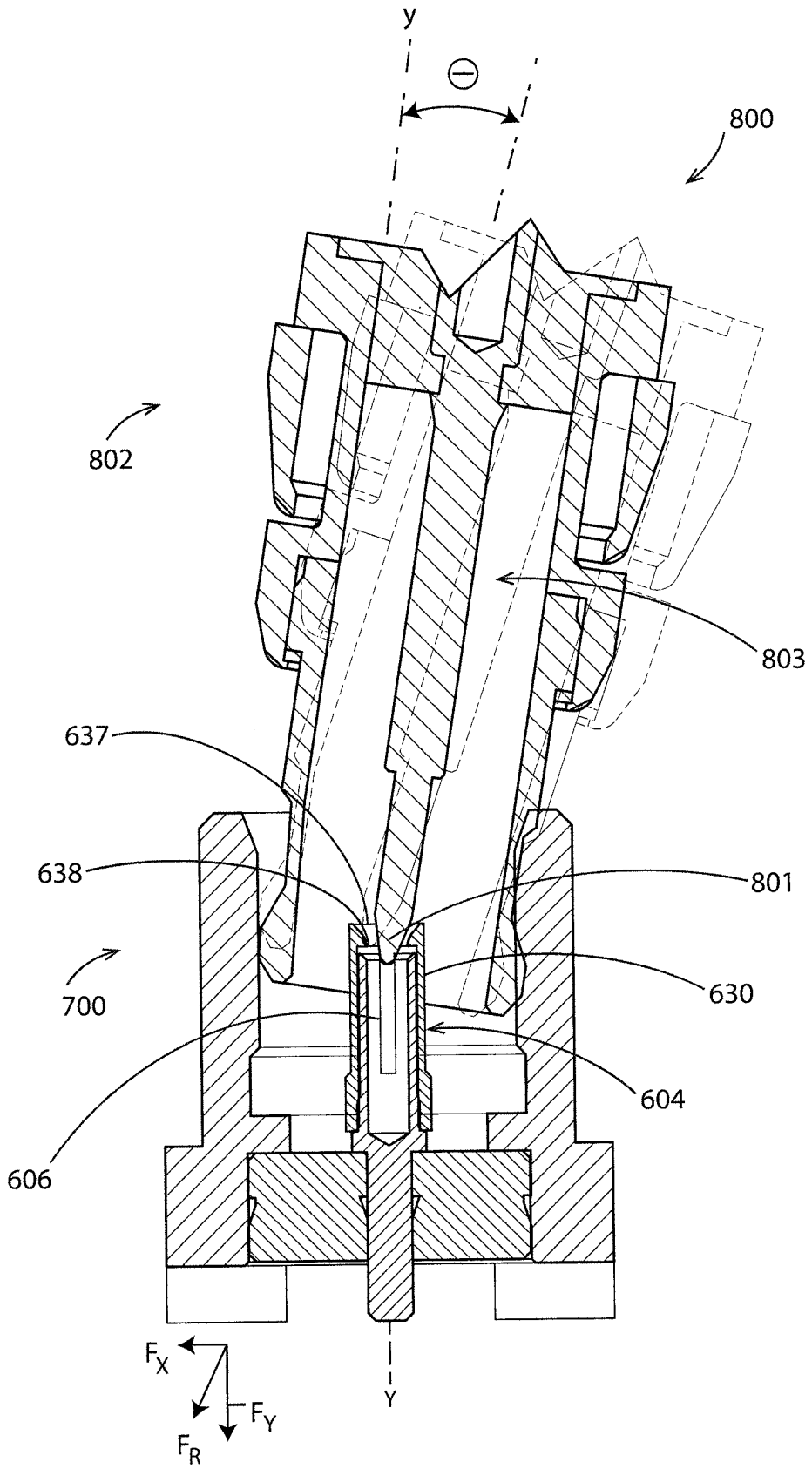
FIG. 8 shows a 75 ohm MCX jack and a 75 ohm MCX plug in accordance with the present invention.

FIG. 8 shows a 75 ohm MCX jack and plug in accordance with the present invention 800. Here, there is an attempt to insert an off-axis/misaligned plug 802 into a mating jack 700 as indicated by the misalignment angle θ. Because of the misalignment, the male pin contact 801 tends to push and bend the tines of the female pin contact 606 away from the centerline y-y of the jack. In an exemplary case of a misaligned insertion, forces exerted on the plug FR (components $F_X$ and $F_Y$) have a misdirected or misaligned component $F_X$ that tends to bend the contact tines.

As can be seen, the pin cap 630 covering and surrounding the female pin contact 604 resists forces tending to push the tines 606 away from the jack centerline y-y. In addition, a chamfer 639 at the mouth 637 of the pin cap and in some embodiments a chamfer 658 at the mouth 657 of the female pin contact serves to guide the pin contact 801 of the male pin center pin 803 into the mouth of the female center pin. Moreover, the pin cap stiffens and supports substantially all of the exposed length of the female pin contact such that forces that would otherwise tend to break or bend the female center pin are resisted and transferred to the jack base insulator. In various embodiments, jack base insulators are made of resilient materials such as polymers, for example polyethylene, that deflect to relieve forces on the female center pin.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A 75 ohm MCX coaxial connector jack comprising:

a jack base insulator extending between a female center pin and a jack outer shell;

a multipurpose metal pin cap fitted to apin contact of the female center pin;

the pin cap operable to protect the female pin contact when an attempt is made to insert a misaligned MCX coaxial connector plug into the jack, a guide-way to the female pin contact;

the guide-way including a substantially conically shaped pin cap mouth;

the pin cap mouth operable to guide the pin contact of a male center pin of a misaligned MCX coaxial connector plug into the female pin contact;

one or more pin cap sidewalls radially outward of tines of the female pin contact;

the pin cap sidewalls operable to resist forces tending to bend the female pin contact tines when the attempt is made to insert the misaligned MCX coaxial connector plug into the jack;

one or more pin cap sidewalls of sufficient length to transfer forces imposed on the pin cap mouth to a portion of the female center pin that is beyond the female pin contact tines and substantially adjacent to the jack base insulator; and, the jack having a slotted pin cap sidewall.

2. A 75 ohm MCX coaxial connector jack comprising:

a jack base insulator extending between a female center pin and a jack outer shell;

a multipurpose metal pin cap fitted to a pin contact of the female center pin;

the pin cap operable to protect the female pin contact when an attempt is made to insert a misaligned MCX coaxial connector plug into the jack, a guide-way to the female pin contact, the guide-way including a pin cap mouth;

the pin cap mouth operable to guide the pin contact of a male center pin of a misaligned MCX coaxial connector plug into the female pin contact;

a slotted pin cap sidewall radially outward of tines of the female pin contact;

the pin cap configured to resist forces tending to bend the female pin contact tines when the attempt is made to insert the misaligned MCX coaxial connector plug into the jack; and, the pin cap sidewall configured to transfer forces imposed on the pin cap mouth to a portion of the female center pin that is beyond the female pin contact tines and substantially adjacent to the jack base insulator.

* * * * *